US008123098B2

(12) United States Patent
Miyata

(10) Patent No.: US 8,123,098 B2
(45) Date of Patent: Feb. 28, 2012

(54) BATTERY HOLDER FOR A DRIVING TOOL

(75) Inventor: Kenichi Miyata, Anjo (JP)

(73) Assignee: Makita Corporation, Anjo-Shi (JP)

( * ) Notice: Subject to any disclaimer, the term of this patent is extended or adjusted under 35 U.S.C. 154(b) by 16 days.

(21) Appl. No.: 12/679,180

(22) PCT Filed: Sep. 18, 2008

(86) PCT No.: PCT/JP2008/066820

§ 371 (c)(1),
(2), (4) Date: Mar. 29, 2010

(87) PCT Pub. No.: WO2009/041336

PCT Pub. Date: Apr. 2, 2009

(65) Prior Publication Data

US 2010/0224666 A1 Sep. 9, 2010

(30) Foreign Application Priority Data

Sep. 27, 2007 (JP) ..... 2007-251347

(51) Int. Cl.
*B25C 1/18* (2006.01)
*B25C 7/00* (2006.01)

(52) U.S. Cl. ..... 227/131; 227/217; 227/8; 227/130; 227/156; 429/96; 429/99; 429/100; 439/500; 439/247; 439/248

(58) Field of Classification Search ..... 173/131, 173/217; 227/8, 130, 156; 429/96, 99–100; 439/500, 247–24
See application file for complete search history.

(56) References Cited

U.S. PATENT DOCUMENTS

| | | | | |
|---|---|---|---|---|
| 5,718,985 | A * | 2/1998 | Bunyea et al. | 429/97 |
| 5,800,940 | A * | 9/1998 | Bunyea et al. | 429/97 |
| 6,179,192 | B1 * | 1/2001 | Weinger et al. | 227/8 |
| 6,357,534 | B1 * | 3/2002 | Buetow et al. | 173/217 |
| 6,619,527 | B1 | 9/2003 | Moeller | |
| 2003/0218045 | A1 | 11/2003 | Shkolnikov | |
| 2006/0289596 | A1 * | 12/2006 | Turk | 227/10 |
| 2008/0099224 | A1 | 5/2008 | Hofmann et al. | |
| 2009/0032563 | A1 | 2/2009 | Yokochi | |

FOREIGN PATENT DOCUMENTS

| | | | |
|---|---|---|---|
| EP | 1 197 300 | A2 | 4/2002 |
| EP | 1 364 751 | A2 | 11/2003 |
| EP | 1 864 759 | A1 | 12/2007 |

(Continued)

OTHER PUBLICATIONS

International Search Report issued in International Application No. PCT/JP2008/066820 by the International Bureau on Nov. 11, 2008. (with English translation).

(Continued)

*Primary Examiner* — Rinaldi I. Rada
*Assistant Examiner* — Michelle Lopez
(74) *Attorney, Agent, or Firm* — Oliff & Berridge, PLC

(57) ABSTRACT

Vibration or the impact of a tool main body may be blocked by the support of a battery holder via elastic materials in a floating state at the rear end portion side in a feed direction of a driven-members-housing magazine and by the attachment of a battery pack to this battery holder.

13 Claims, 4 Drawing Sheets

FOREIGN PATENT DOCUMENTS

| | | | |
|---|---|---|---|
| GB | 2 432 036 | A | 5/2007 |
| JP | A-58-106758 | | 6/1983 |
| JP | A-10-296660 | | 11/1998 |
| JP | A-2001-325932 | | 11/2001 |
| JP | A-2002-144253 | | 5/2002 |
| JP | A-2003-297312 | | 10/2003 |
| JP | A-2004-1193 | | 1/2004 |
| JP | A-2005-1065 | | 1/2005 |
| JP | A-2006-281398 | | 10/2006 |
| WO | WO 2004/096500 | A1 | 11/2004 |

OTHER PUBLICATIONS

European Search Report issued in European Patent Application No. 08833260.6 dated Apr. 27, 2011.

* cited by examiner

BATTERY HOLDER FOR A DRIVING TOOL

BACKGROUND OF THE INVENTION

1. Field of the Invention

The present invention relates to a driving tool equipped with a rechargeable battery pack as a power source, for example, a gas combustion type driving tool for driving nails.

2. Description of the Related Art

For instance, as a driving tool such as a nail driver, a gas combustion type driving tool, which strikes driven members by reciprocating a piston with gases exploded in a combustion chamber, has been proposed as well as a driving tool using compressed air as a driving source. In the case of this gas combustion type driving tool, a fan is provided in a combustion chamber in order to stir the gases supplied into the combustion chamber and air introduced from outside to the combustion chamber in an appropriate ratio or to accelerate evacuation from the combustion chamber after combustion (after striking driven members). This fan in the combustion chamber rotates with an electric motor as a drive source. This electric motor for driving the fun in the combustion chamber uses, for example, a rechargeable battery pack as a power source, and this battery pack is detachably attached in the vicinity of a handle portion of the driving tool.

In an electric driving tool equipped with a detachable battery pack for charging etc. as described above, various technologies have been proposed regarding a structure for attaching this battery pack to a tool main body side, as provided, for example, in Japanese Laid-Open Patent Publication No. 10-296660, Japanese Laid-Open Patent Publication No. 2004-1193, and Japanese Laid-Open Patent Publication No. 2003-297312. Most of these technologies in the art relate to an electric tool to which substantially fixed and comparatively small vibration is consecutively applied during the use of an electric drill and an electric screwdriver etc., and special measures for the battery pack against the vibration are not required. Further, in Japanese Laid-Open Patent Publication No. 2004-1193, a technology is described regarding a gas combustion type driving tool in which a large vibration or impact is applied to the main body as a force of reaction each time a striking movement is made (intermittently).

However, the technology described in Japanese Laid-Open Patent Publication No. 2004-1193 is to prevent an electric contact failure against terminal blocks of the battery pack, which is caused by the vibration etc. occurred each time a striking movement is made to the tool body. Therefore, it is required to reliably prevent other failures (for example, falling of the battery pack etc.) caused by the vibration etc.

Thus, there is a need in the art to prevent various failures predicted to occur by a large vibration or impact caused each time a striking movement is made in a driving tool equipped with a detachable battery pack as a power source such as a gas combustion type nail driver etc.

SUMMARY OF THE INVENTION

According to a first aspect of the invention, a battery pack is attached to a battery holder supported in a floating state with regard to the tool main body via an elastic material, electrically connected via this battery holder with regard to the tool main body, and attached so that the battery pack may not fall off. And thus, the vibration or the impact as a force of reaction caused by a striking movement at the tool main body side is absorbed by the elastic material, and transmission of the vibration or impact to the battery holder is greatly restricted. As a result, an electrical contact and an attaching state of the battery pack with respect to the battery holder can be maintained satisfactorily.

According to a second aspect of the invention, the battery holder can be supported in a floating state with regard to the tool main body in a simple and an inexpensive configuration.

According to a third aspect of the invention a nail feed direction is configured in a cross direction with regard to a striking direction of the driving tool, and an attaching direction of the battery pack is configured along this nail feed direction. And thus, the battery pack slides in the cross direction with regard to the striking direction of driven members, and is attached to and detached from the battery holder. As a result, only a part of the vibration and impact caused by the striking movement may act in the detaching direction of the battery pack. In this respect, the vibration or the impact transmitted to the battery pack can be further reduced, whereby it is ensured that an electric contact failure of the battery pack can be reliably reduced and unintended falling out of the battery of the battery pack can be prevented.

According to another aspect of the invention, even if the tool main body falls off accidentally, the battery pack can be prevented from directly hitting a floor etc., and thus damage to battery pack can be prevented.

DETAILED DESCRIPTION OF THE INVENTION

Figure 1:
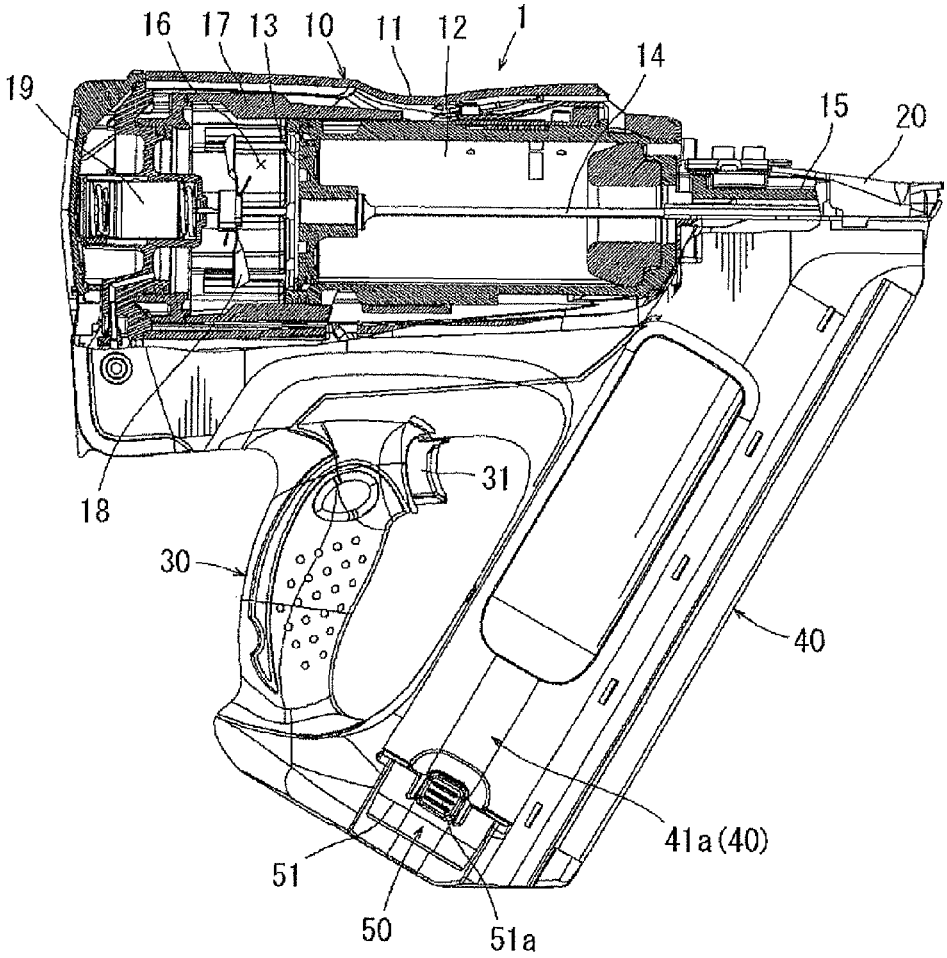
FIG. 1 is a general side view of a driving tool according to an embodiment of the present invention and a gas combustion type driving tool for driving nails. This figure shows a state in which the tool is equipped with a battery pack.

Next, an embodiment of the present invention will be described with reference to FIG. 1 to FIG. 4. In this embodiment, a gas combustion type nail driver is illustrated as an example of a driving tool. FIG. 1 shows an overall driving tool 1 according to this embodiment. This driving tool 1 includes a tool main body 10, a handle portion 30 provided in a state in which it protrudes laterally from the lateral part of the tool main body 10, and a driven-members-housing magazine 40 provided to extend between a distal end portion of the tool main body 10 and a distal end portion of the handle portion 30. A battery pack 51 is attached to the distal end portion of this driven-members-housing magazine 40 (a rear end portion with respect to a feed direction of driven members, a lower end portion in FIG. 1). The embodiment is characterized in the attachment configuration of this battery pack 51, and a basic configuration of the driving tool 1 such as the tool main body 10 requires no particular changes. A brief explanation will be described below.

The tool main body 10 is provided with a cylinder 12 and a piston 13 in a tubular main body case 11. In the center of the piston 13, a striking driver 14 is mounted. This driver 14 is elongated forward in a striking direction, and the distal end portion is directed into a striking driver guide 15 in which a driven member is fed one by one. The driver guide 15 is provided in a state in which the driver guide 15 protrudes from a lower part of the tool main body 10. A driven member is struck by this driver 14 and driven out of the distal end of the driver guide 15.

At a rear portion of the tool main body 10 (an left end portion in FIG. 1) and an upper face side of the piston 13, a combustion chamber 16 is provided. This combustion chamber 16 is opened and closed by a tubular chamber 17 that moves along the striking direction.

In the combustion chamber 16, a stirring fan 18 is mounted. This fan 18 rotates with a fan motor 19. Further, though not seen in FIG.1, an ignition plug is mounted in the combustion chamber 16. Power to this ignition plug and the above fan motor 19 is supplied by the above battery pack 51.

Further, though omitted in the figure, a cassette gas cylinder filled with combustion gases for supplying in the combustion chamber 16 is housed in the tool main body 10. Combustion gases for one-time combustion that are supplied from this gas cylinder to the combustion chamber 16 are stirred and mixed with air in an appropriate mixing ratio by the rotation of the fan 18, whereafter when the ignition plug is ignited, the combustion gases explode and the piston 13 moves downward. When the piston 13 moves downward, one driven member fed to the driver guide 15 is struck by the driver 14, which drives the driven member out of the distal end of the driver guide 15.

In the driver guide 15, a contact lever 20 is provided such that it can be moved along a striking direction. This contact lever 20 is maintained at a position where it protrudes from the distal end of the driver guide 15 by a given size. When the distal end portion (striking exit) of the driver guide 15 is pressed against a driven material to move the contact lever 20 relatively upward (on), the chamber 18 is closed so that combustion gases are supplied into the combustion chamber 16 and the fan 18 starts to rotate.

At a base portion of the handle portion 30, a trigger-type switch lever 31 is provided. When this switch lever 31 is pulled with a fingertip in a state in which the above contact lever 20 is turned on, the ignition plug is ignited, whereby a driving operation is performed once by combustion (explosion) of the combustion gases.

The cylinder 12, the piston 13, the driver 14, the driver guide 15, and the combustion chamber 16 etc. may serve as a driving mechanism for striking driven members, and these components include a striking mechanism.

The driven-members-housing magazine 40 functions to load thin-sheet-shaped connected members that connect a number of driven members in parallel, to pitch and feed these connected members in a feed direction (toward the driver guide 15 side) in association with a driving movement of the tool main body 10 side, and thereby to feed driven members one by one into the driver guide 15.

Figure 2:
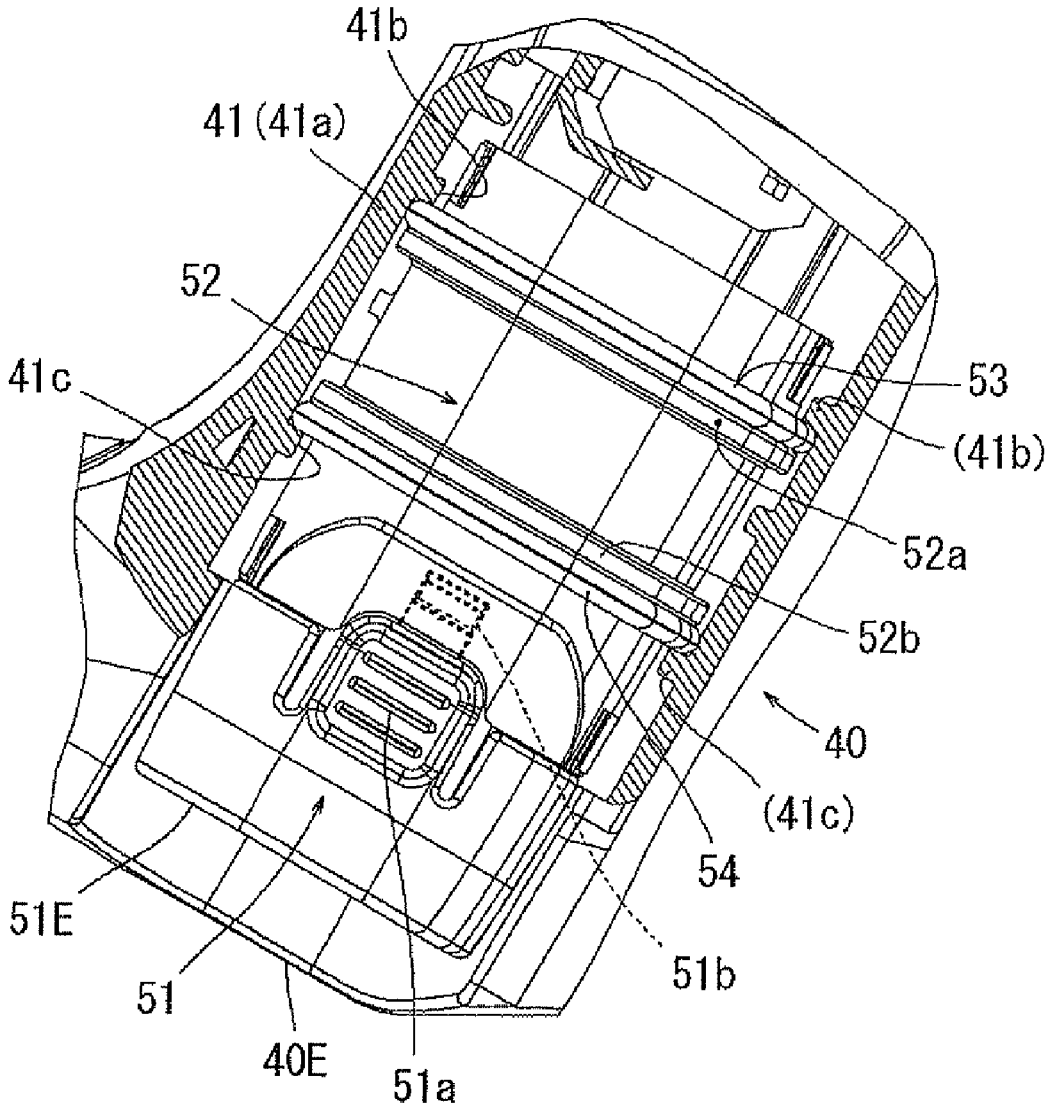
FIG. 2 is a side view of a rear end portion side of a driven-members-housing magazine, and shows a state in which a battery holder is exposed by fracture of a part of the rear end portion.
Figure 4:
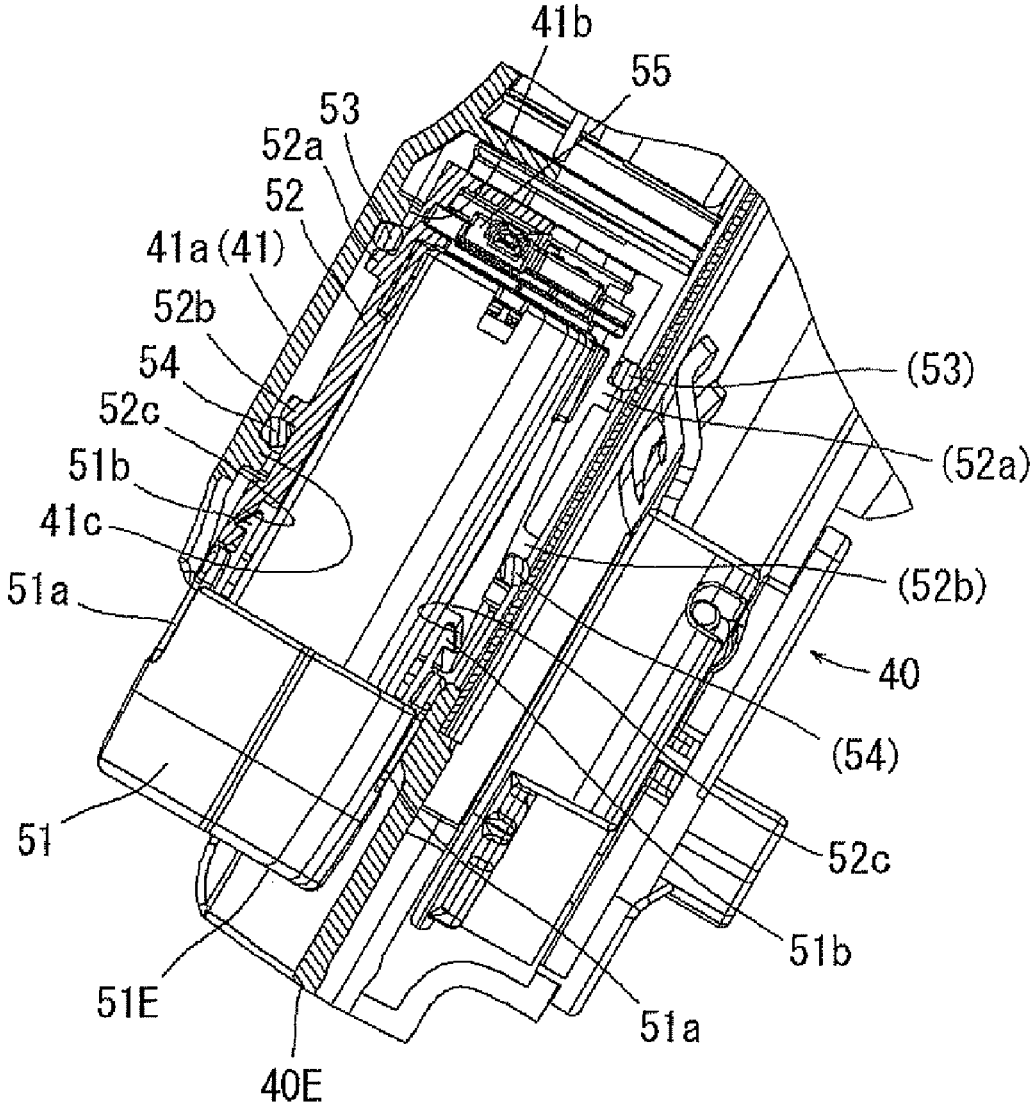
FIG. 4 is a view taken along the line indicated by arrows (4)-(4) of FIG.3 and a longitudinal cross-sectional view of the driven-members-housing magazine and the battery holder along a feed direction of driven members. This figure shows a state in which the attached battery pack is exposed.

At a lateral lowered side of this driven-members-housing magazine 40 in the striking direction of the driven members, a battery attachment section 50 for attaching a battery pack 51 is provided. The detail of this battery attachment section 50 is shown in FIG. 2 and its subsequent figures. As shown in FIG. 4, a lower part of a magazine case 41 of the driven-members-housing magazine 40 has a shape that is slightly swollen laterally, and a battery holder 52 is supported within the swollen portion 41*a*. The magazine case 41 has a so-called two-piece structure. By use of this two-piece structure, the battery holder 52 is mounted and supported at a lower part of the magazine case 41.

The battery holder 52 has a substantially tubular shape, and in its outer circumferential side two elongated protrusions 52*a* and 52*b* are integrally formed along its entire circumference. Above the upper elongated protrusion 52*a* and below the lower elongated protrusion 52*b* in FIG. 4, rubber rings 53 and 54 are fitted respectively. In this specification, unless otherwise noted, an upper side means a forward side in a striking direction of driven members (toward the upper side in the figures) and a lower side means a backward side against the striking direction of driven members (toward the lower side in the figures).

On the other hand, two engaging projections 41*b* and 41*c* are formed integrally on the inner side of the swollen portion 41*a* of the magazine case 41. The battery holder 52 is supported in the swollen portion 41*a* of the magazine case 41 in a state in which the upper rubber ring 53 is elastically interposed between the upper engaging projection 41*b* and the upper elongated protrusion 52*a*, and the lower rubber ring 54 is elastically interposed between the lower engaging projection 41*c* and the lower elongated protrusion 52*b*. Two elongated protrusions 52*a* and 52*b* are not in contact with the magazine case 41 side. Further, other portions of the battery holder 52 do not hold in contact with or are not in contact with the magazine case 41, either. The battery holder 52 is supported in a floating state in the swollen portion 41*a* of the magazine case 41 in a state in which only two rubber rings 53, 54 are in contact with the magazine case 41. In this way, the battery holder 52 is supported in the magazine case 41 via only rubber rings 53 and 54, which are elastic material, in a floating state, and thus the vibration or the impact (a force of reaction caused by a striking movement) occurred at the tool main body 10 side can be blocked and all of the vibration or the impact may not be transmitted to the battery holder 52. As a result, the vibration etc. transmitted to the battery holder 52 can be greatly reduced. A battery pack 51 is attached to this battery holder 52 supported in a floating state.

Figure 3:
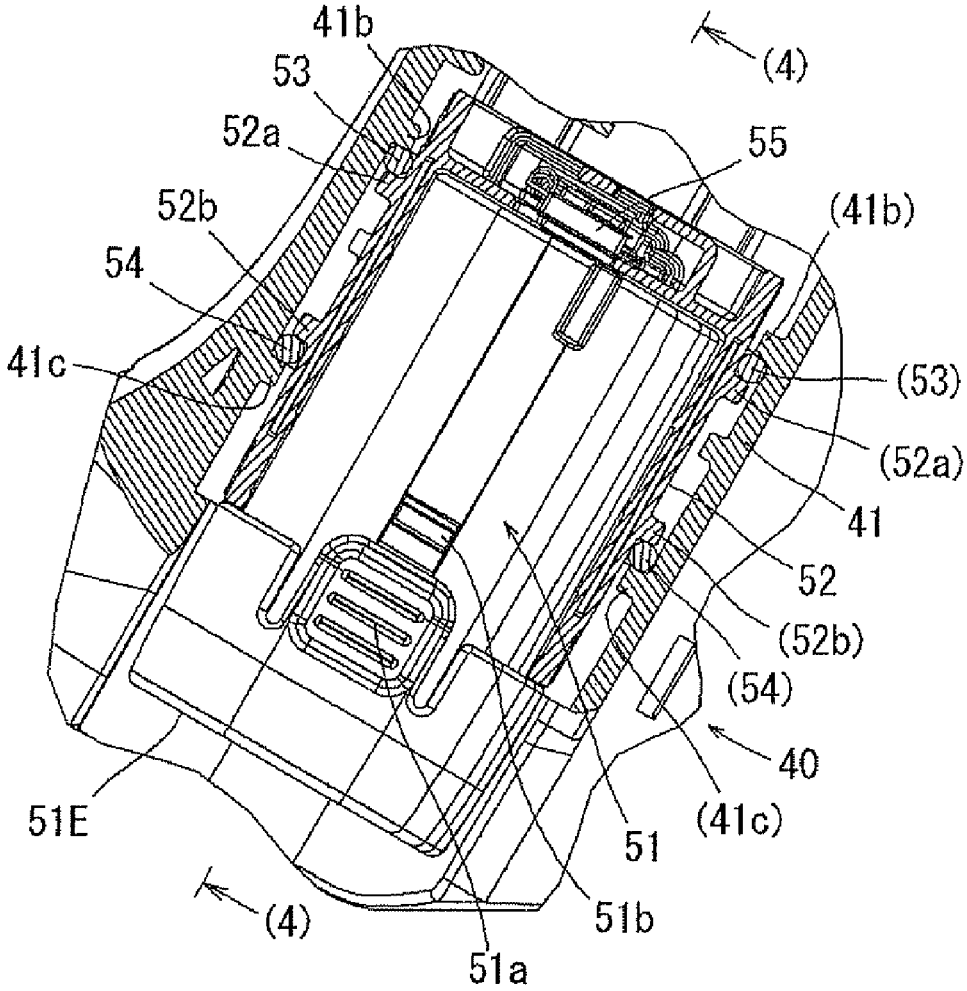
FIG. 3 is a lateral cross-sectional view of the driven-members-housing magazine and the battery holder, and shows a state in which an attached battery pack is exposed.

As shown in FIG. 3 and FIG. 4, a terminal block 55 is mounted in the rear part of the battery holder 52. This terminal block 55 is electrically connected to a control circuit of the tool main body 10 via lead wires that is not shown. And thus, the battery pack 51 attached to the battery holder 52 is electrically connected to the control circuit of the tool main body 10 side via this terminal block 55.

At both sides of a lowered portion of the battery pack 51 in an attaching direction, push buttons 51*a*, 51*a* for a removing operation are provided. The double push buttons 51*a*, 51*a* are provided in a biased state in an opening direction respectively (toward a mutually separating direction). At the tip of the double push buttons 51*a*, 51*a*, engaging claws 51*b* are integrally provided respectively. With an operation for attaching the battery pack 51 to the battery holder 52, both of the engaging claws 51*b*, 51*b* are elastically engaged respectively with engaging concave portion 52*c*, 52*c* provided on the inner side of the opening of the battery holder 52. And thus, the attaching state of the battery pack 51 with respect to the battery holder 52 is maintained.

In this attaching state, the battery pack 51 is attached in a state in which an end portion 51E of the rear side of the battery pack 51 in the attaching direction is located such that the end portion 51E may not protrude from an end portion 40E of the driven-members-housing magazine 40, as shown in the figure.

A push operation of the push buttons 51*a* with a fingertip can detach the engaging claws 51*b* from the engaging concave portion 52*c*, and in this disengagement state the battery pack 51 can be pulled off and removed from the battery holder 52.

According to the driving tool in the embodiment as constructed thus far, the battery pack 51 is attached to the terminal blocks of the driven-members-housing magazine 40 via the battery holder 52.

The battery holder 52 is supported in a floating state (elastically supported) with respect to the magazine case 41 in a state in which the battery holder 52 is elastically in contact with only the rubber rings 53, 54 by elastically pressing and interposing the two rubber rings 53, 54, which are fitted to the outer circumference of the battery holder 52 between the elongated protrusions 52*a*, 52*b* and the engaging projections 41*b*, 41*c* of the magazine case 41 side. As a result, the vibration or the impact caused by the drive movement of the tool main body 10 can be blocked with both the rubber rings 53, 54, and the transmission of the vibration or the impact to the battery holder 52, and eventually to the battery pack 51, can be greatly reduced.

Since the vibration or the impact transmitted to the battery pack 51 can be greatly reduced in this way, an electrically contact state and an attaching state with respect to the tool main body 10 side of the battery pack 51 can be maintained in a good condition, and thus a failure such as adhesion or chattering of electric contacts can be prevented (protection of electrical contacts), and an unintended falling of the battery pack 51 can be prevented (protection of the battery pack itself).

Further, according to the driving tool 1 in the embodiment, the configuration is such that the battery pack 51 is attached in the rear end portion of the driven-members-housing magazine 40 and in a far-away portion from a driving axis of the tool main body 10. In this respect, the battery pack 51 is not subject to the influence of the vibration or the impact of the tool main body 10 side.

Further, according to the driving tool 1 in the embodiment, the attaching direction of the battery pack 51 with respect to the battery holder 52 corresponds with the feed direction of the driven-members-housing magazine 40, and thus the attaching direction of the battery pack 51 is configured in a cross direction with respect to the striking direction of the tool main body 10 (toward a moving direction of the driver 14). For this reason, a part of the vibration or the impact in the striking direction caused by the strike of the driver 14 with respect to driven members may act in the attaching direction of the battery pack 51. In this respect, the battery pack 51 is not subject to the influence of the vibration or the impact that causes a failure such as chattering of electric contacts or an unintended falling by the disconnection from the engaging claws 51*b*.

Further, according to the driving tool 1 as exemplified, the battery pack 51 is attached in a state in which the rear end portion 51E of the battery pack 51 does not protrude from the rear end portion 40E of the driven-members-housing magazine 40. For this reason, in case that a user unintentionally drops the driving tool 1, the rear end portion 40E of the magazine 40 may hit a floor etc. but the battery pack 51 can be prevented from directly hitting a floor, and thus damage of the battery pack 51 can be prevented.

Various modifications can be made to the embodiment described above. For example, a configuration is exemplified in which the battery pack 51 is supported in a floating state via two rubber rings 53, 54, but three rubber rings or more may be used as elastic members. Further, by using other elastic materials in place of rubber rings such as a compression coil spring, a tension spring, or a leaf spring, a similar function effect can be obtained. Further, by using screws with rubber bushings, the battery holder may be supported in a floating state. The key is to interpose elastic materials between the battery holder and the tool main body 10 side without rigidly connecting the battery holder and the tool main body 10 and to support the battery holder in the tool main body 10 side in a floating state in which the vibration or the impact may be blocked, and thus a similar function effect can be obtained.

Further, a gas combustion type nail driver is exemplified as an example of driving tools, but the embodiment can also be applied to driving tools in which a battery pack, which can be removed for charging or can be detached and exchanged, may be used as a power source for an electric motor or other electric appliances.

The invention claimed is:

1. A driving tool, comprising:

a battery holder supported in a floating state via an elastic material with respect to a tool main body that incorporates a driving mechanism;

a battery pack as a rechargeable power source that is electrically connected to said tool main body via said battery holder, said battery pack being engaged with said battery holder so that said battery pack is not possible to fall out of said battery holder; and a driven-members-housing magazine for housing a plurality of driven members driven by said tool main body and for feeding driven members one by one to said tool main body, wherein the battery holder is supported proximate a lateral side of said magazine so an attaching direction of said battery pack with respect to said battery holder corresponds to a feed direction of driven members fed by said magazine to said tool main body, engaging projections are provided along an inner circumferential surface of a battery attachment section of said magazine, elongated protrusions are provided along an outer circumferential surface of said battery holder that is housed in said battery attachment section, and said battery holder is supported in the floating state with respect to said magazine by the position of the elastic material between the elongated protrusions and the engaging projections in a feed direction of said driven members, the elastic material fitted to an outer surface of said battery holder along the elongated protrusions.

2. The driving tool according to claim 1, wherein said battery holder has a tubular shape.

3. The driving tool according to claim 1, wherein the elastic material is rubber rings.

4. The driving tool according to claim 1, wherein said battery pack is attached to said battery holder in a state in which said battery pack does not protrude from an end portion of said magazine.

5. The driving tool according to claim 1, wherein:

a terminal block is provided in said battery holder that is electrically connected to a control circuit of said tool main body via lead wires; and a battery pack attached to said battery holder is electrically connected to said control circuit of said tool main body via the terminal block.

6. A driving tool, comprising:

a battery holder supported in a floating state via an elastic material with respect to a tool main body that incorporates a driving mechanism; and a battery pack as a rechargeable power source that is electrically connected to said tool main body via said battery holder, said battery pack being engaged with said battery holder so that said battery pack is not possible to fall out of said battery holder, wherein engaging projections are provided along an inner circumferential surface of a battery attachment section of said tool main body, elongated protrusions are provided along an outer circumferential surface of said battery holder that is housed in said battery attachment section, and said battery holder is supported in the floating state with respect to said tool main body by the position of the elastic material between the elongated protrusions and the engaging projections, the elastic material fitted to an outer surface of said battery holder along the elongated protrusions.

7. The driving tool according to claim 6, further comprising a driven-members-housing magazine for housing a plurality of driven members driven by said tool main body and for feeding driven members one by one to said tool main body, wherein the battery holder is supported proximate a lateral side of said magazine.

8. The driving tool according to claim 7, wherein an attaching direction of said battery pack with respect to said battery holder corresponds to a feed direction of driven members fed by said magazine to said tool main body.

9. The driving tool according to claim 8, wherein the elastic material is positioned in the feed direction of the driven members.

10. The driving tool according to claim 7, wherein said battery pack is attached to said battery holder in a state in which said battery pack does not protrude from an end portion of said magazine.

11. The driving tool according to claim 6, wherein said battery holder has a tubular shape.

12. The driving tool according to claim 6, wherein the elastic material is rubber rings.

13. The driving tool according to claim 6, wherein:

a terminal block is provided in said battery holder that is electrically connected to a control circuit of said tool main body via lead wires; and a battery pack attached to said battery holder is electrically connected to said control circuit of said tool main body via the terminal block.

* * * * *